United States Patent [19]

Shotbolt

[11] 4,317,488

[45] Mar. 2, 1982

[54] APPARATUS FOR USE IN PLACING A SUBMARINE STRUCTURE ON THE SEA BED ALONGSIDE AN UNDERWATER WELL AND METHOD OF DRILLING A PLURALITY OF CLOSELY SPACED UNDERWATER WELLS

[75] Inventor: Keith Shotbolt, Gerrards Cross, England

[73] Assignee: The British National Oil Corporation, London, England

[21] Appl. No.: 121,453

[22] Filed: Feb. 14, 1980

[30] Foreign Application Priority Data

Feb. 15, 1979 [GB] United Kingdom ..... 5452/79
Apr. 9, 1979 [GB] United Kingdom ..... 12469/79

[51] Int. Cl.[3] ..... E21B 33/035
[52] U.S. Cl. ..... 166/351; 166/362; 166/366
[58] Field of Search ..... 175/7; 166/341, 342, 166/343, 358, 360, 351, 362, 366; 465/195

[56] References Cited

U.S. PATENT DOCUMENTS

| | | | |
|---|---|---|---|
| 3,025,916 | 3/1962 | Frick | 175/7 |
| 3,934,658 | 1/1976 | Nelson | 175/7 |
| 4,126,008 | 11/1978 | Dixon | 175/7 X |
| 4,211,281 | 7/1980 | Lawson | 166/366 |
| 4,216,835 | 8/1980 | Nelson | 166/338 |
| 4,230,186 | 10/1980 | Lewis, Jr. | 175/7 X |

*Primary Examiner*—William F. Pate, III
*Attorney, Agent, or Firm*—Fleit & Jacobson

[57] ABSTRACT

A template for spacing a submarine structure such as an anchor block or a guide base for a second underwater well alongside an existing underwater well comprises a beam attached at one end, by means of a hinge, to a lowering guide which can be threaded over and be lowered along two guide wires of the first well, and at the other end by a remote-controlled release mechanism to the submarine structure such as the anchor block itself or a guide base for a second well.

The beam, with such a submarine structure attached, is lowered down the guide wires while held in a vertical configuration, and is then swung into a generally horizontal configuration at the sea bed.

12 Claims, 6 Drawing Figures

Figure 4:
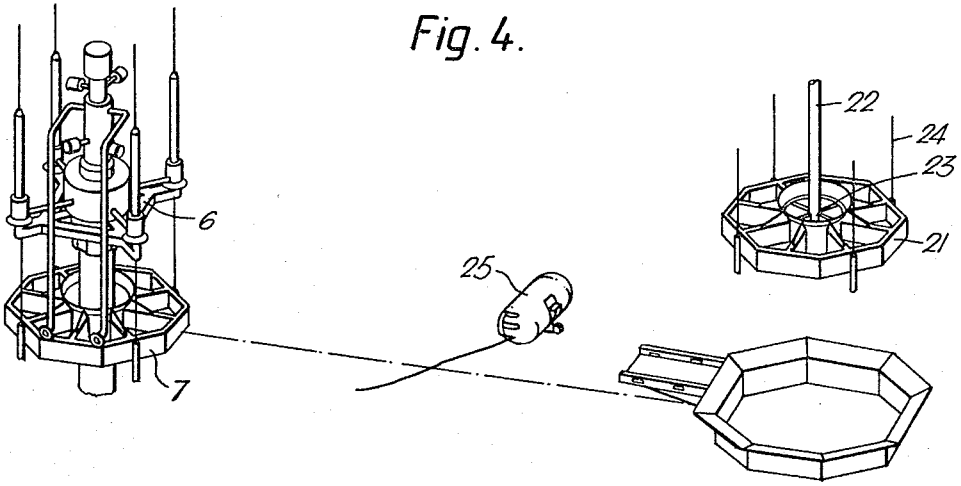

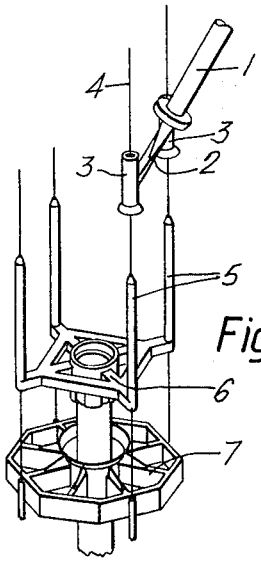
Fig.1.
Fig.3.
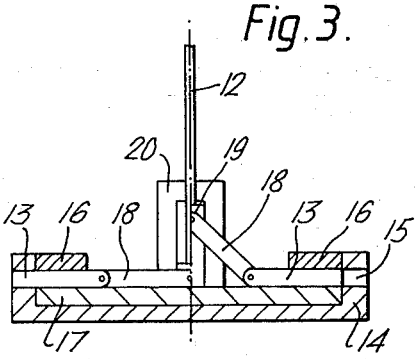
Fig.2.
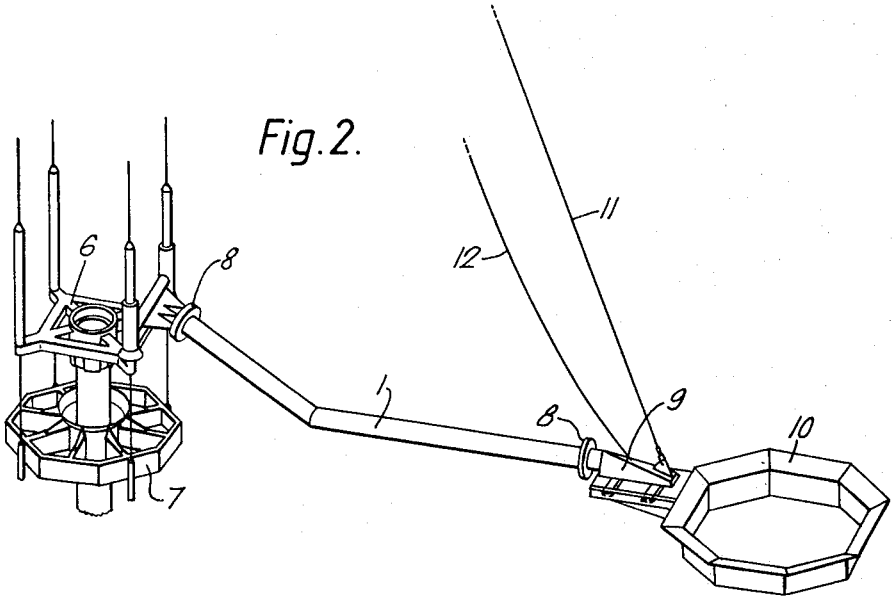

APPARATUS FOR USE IN PLACING A SUBMARINE STRUCTURE ON THE SEA BED ALONGSIDE AN UNDERWATER WELL AND METHOD OF DRILLING A PLURALITY OF CLOSELY SPACED UNDERWATER WELLS

DESCRIPTION

The present invention relates to the positioning of a submarine structure, such as a template used when drilling an underwater well, or an anchor block for flow lines in oil recovery, alongside and in close proximity to an underwater well and to a method of drilling a plurality of underwater wells in close proximity.

The procedure for drilling an underwater oil or gas well from a floating rig begins typically with the installation of a temporary guide base, TGB, which is lowered with a running tool, on drill pipe, to the sea bed with four guide wires attached at equal spacing on a circle, usually of 12 feet diameter.

When the TGB running tool has been recovered, a drill bit (usually 36" in diameter) is lowered with a centralising collar spaced from a pair of diagonally opposite TGB guide wires, so that it pierces the sea bed centrally through the TGB. The bit drills a hole usually between 150 and 400 feet deep, and is then recovered while drilling mud maintains an open hole. Conductor pipe, normally 30" in diameter, is made up to a similar length, with a cementing valve at the leading end, and a housing at the top which supports the permanent guide base PGB. The PGB has four vertical posts (usually 8" in diameter and about 15 feet long) which are threaded over the guide wires on the same pitch circle. The PGB and the conductor pipe are then lowered until the PGB comes to rest on the TGB. In many cases this may not quite happen, as most drillers prefer to stand the PGB about 5 to 10 feet above the mudline to prevent cement returns fouling the PGB. After cementing, the conductor pipe and PGB are firmly positioned and act as guidance for further drilling and as a support for the blow out preventor, BOP. The TGB rests directly on the sea bed which may not be level, but the PGB is usually set true if the 36" hole has been drilled steadily to prevent deviation from the vertical.

For sub sea production, when several wells are completed on the sea bed and hydrocarbons are to flow to a nearly separation platform, it is usually preferable to group the wells in a cluster, in order both to avoid spreading equipment over a large area of sea bed and to ease maintenance. Well clusters have previously been drilled through a multi-slot template on spacings up to 15 feet. However, the BOP can typically be 15 feet wide, 50 feet high, and can weigh 200 tons; in the case of about 1 percent of holes drilled or serviced the BOP is dropped. Because mishandling of the BOP could cause a large amount of damage to sub sea well completions and multi-slot templates, some engineers prefer to space the wells in a cluster between 50 and 75 feet apart. This can be attempted using the drilling rig positioning sonar beacon, but with a limitation on accuracy of $\pm 1$ percent of water depth, and full-scale range of 10 percent of water depth, (i.e. $\pm 5\%$ about the overhead position). Another advantage of a cluster of widely spaced wells is that a completed well can be tied in, and its oil can begin flowing to a nearby platform, while other wells of the cluster are being drilled. Revenue and reservoir information are thus gained in advance, whereas with a closely spaced template, early production would be more hazardous.

A previous well spacing template is described in U.S. Pat. No. 3,934,658, but this uses a non-standard guide base, and is very difficult to handle as the spacing beam is lowered in the horizontal position. For well spacings of 50 to 75 feet, it is much more practical to lower the beam vertically, and it is also in any case advantageous to re-use the beam for subsequent wells rather than to leave it on the sea bed as suggested by the above-mentioned United States Patent Specification.

The TGB of a subsequent well is not the only structure which needs to be placed on the sea bed close to an existing well where at least the PGB has been installed. It is, for example, customary to anchor the flow lines for recovering the product liquid or transporting secondary recovery fluids such as injection water or lifting gas along flow lines which may be linked either to the rig or to a shore terminal. In order to ensure that any inadvertent fouling of these lines, for example by trawl boards or ship's anchors, will not cause damage to the well head it is customary to anchor the flow lines to the sea bed by use of an anchor block pinned to the sea bed by cemented piles. The anchor block is usually placed close to a well or a cluster of wells and the flow line fastened to the anchor block is then connected to a nearby well using fittings which carry the product liquid or other fluid in question from the well head to the anchored flow line end. It is advantageous if the spacing and orientation of the anchor block relative to the well head is carefully controlled so that standard connecting fittings can be used.

The purpose of the present invention is to facilitate the positioning of a submarine structure on the sea bed alongside an underwater well at a predetermined spacing from the well. Thus it should be possible (a) to position an anchor block at a given spacing from a well; or (b) to space a subsequent well from an existing well at least on accurate centre-to-centre distances, so that individual protective covers can be set to form a practically continuous shield to wellheads and pipework, and preferably also with controlled orientation, so that flowlines can be connected using misalignment unions to avoid the adjustment of pipe templates on the sea bed and the fabrication of special angled spool pieces; or (c) to position any other form of submarine structure from an existing well, as desired.

According to one aspect of this invention we provide apparatus for positioning a submarine structure on the sea bed alongside an underwater well such apparatus consisting of a beam having, at one end, a hinge for attachment to guide means able to locate on a guide base used for drilling the said underwater well, said beam having at the other end a remote release mechanism to permit attachment to and release of a submarine structure to be positioned. The hinge may have the guide means permanently attached thereto. The said submarine structure may be some form of means to position a second underwater well. Preferably the said means to position a second underwater well will be a temporary guide base. Alternatively the said submarine structure may be an anchor block for anchoring flow line ends close to the said underwater well by pinning to the sea bed using cemented piles.

According to a second aspect of the apparatus there is provided a method of locating first and second spaced underwater structures of which said first structure is a hydrocarbon well, such method comprising drilling a hole for said well; lowering a permanent guide base and conductor piping into position in relation to said hole; providing guide wires extending back from the permanent guide base to the driling rig at the surface; attaching to said guide wires a beam having at a first end guide means for cooperation with the guide wires to guide said beam vertically down the guide wires, and having at the other end a remote release mechanism to permit attachment to and release of a means to position a second underwater well, the first end of said beam being attached to said guide means by way of a hinge permitting the beam to be pivoted between a vertical orientation and a horizontal orientation; attaching to said remote release mechanism a means to position said second underwater structure; lowering said beam in a vertical orientation down said guide wires to the permanent guide base of the first well; at the permanent guide base pivoting said beam into a horizontal orientation to bring said means to position said second underwater structure into a position at the sea bed spaced at a predetermined distance from said permanent guide base of the first well; operating said remote release mechanism to release said beam from said means to position a second underwater structure; and recovering said beam, hinge and guide means by raising them up the said guide wires in a vertical orientation.

The second underwater structure may be a guide for locating the drill for a second adjacent well to be closely spaced from the first. Alternatively the second underwater structure may be an anchor block for locating and securing product flow lines from the first well.

The whole apparatus is operable by first threading guide wires through said guide means at the deck of a floating drilling rig. Where the guide means and hinge are separable the beam may be suspended vertically in the derrick of said rig and lowered and connected by means of said hinge means to the guide means. The guide means, hinge and beam are lowered so that the other end of the beam is at deck level on the rig, and then said submarine structure (for example an anchor block or a TGB for a second underwater well) can be attached using said release mechanism. The whole assembly is then lowered with the beam in the near vertical orientation until the guide means locates over said posts of said first drilling guide base. The beam is then lowered from the near vertical to the near horizontal orientation so that the submarine structure rests on the sea bed. If necessary, the drilling rig can manoeuvre to pull the beam to swivel in the required direction about the horizontal axis. When the positioning means contacts the sea bed, operation of the release mechanism disconnects the beam which is recovered to the drilling rig.

In one form of the apparatus, the beam is a tube with flanges at each end to ease attachment to the hinge and the remote release mechanism. The flanges may seal off the ends of the tube, so that entrapped air will provide buoyancy when the beam is under water. The submerged weight of the beam will then be much less than the weight in air. The beam can be lengthened as required by adding further pieces of similar cross-section and with similar flanged ends.

Usually, the guide base of the first well will incorporate four guide posts, and the guide means will be able to locate on at least two of these, after being lowered down two guide wires from the drilling rig. The guide means, normally having the appearance of two inverted small funnels will have slots to allow the wires to be threaded through laterally.

The remote release mechanism will usually be such that its function is much easier when the tension in the release wire acts in a direction generally perpendicular to the beam rather than along its axis. Where the submarine structure is a means to position a second underwater well, this means will most frequently consist of a socket (for example large funnel) being dimensioned to locate a second guide structure (e.g. a TGB) when lowered from the drilling rig. Alternatively, the means to position a second underwater well could comprise the second temporary guide structure itself.

The means to position a second underwater well may act solely to space the well at the correct distance without attempting to orientate the permanent guide structure of the second well about the vertical axis of the conductor piping of that well. The four guide wires may be installed by attachment to the permanent guide structure which structure may be set in the required direction by mounting a compass on the permanent guide structure and watching the compass needle using underwater television. The drill pipe used to run the conductor pipe and the permanent guide structure can be rotated until the permanent guide structure of the second well has the required directional heading.

Figure 5:
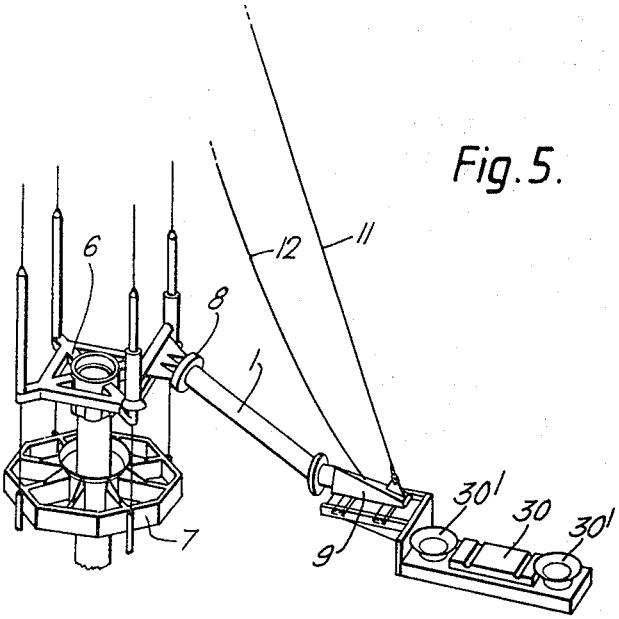
Figure 6:
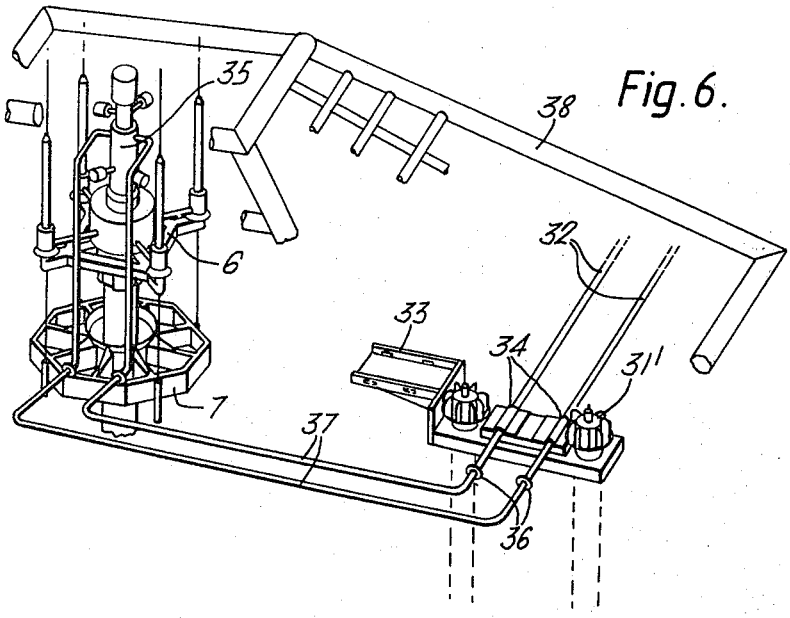

In order that the present invention may be more readily understood, the following description is given, merely by way of example, reference being made to the accompanying drawings wherein:

FIG. 1 is a view showing the temporary and permanent guide bases installed with the spacer beam being lowered in a near vertical orientation, FIG. 2 is a view showing the spacer beam in a near horizontal orientation, with the funnel resting on the sea bed, FIG. 3 is a cross-sectioned view of a remote release mechanism, FIG. 4 is a view showing the second temporary guide base being lowered into the funnel;

FIG. 5 is a perspective view of an alternative form of the apparatus in use for lowering an anchor block into position on the sea bed; and FIG. 6 is a further perspective view, showing the anchor block pinned on the sea bed by cemented piles, and illustrating a protective cage covering the well head and the flow line terminal.

In FIG. 1 the beam 1, hinge means 2 and guide means 3 are lowered down the guide wires 4 onto guide posts 5 of a permanent guide base 6 of an underwater well drilled through a temporary guide base 7 which is resting on the sea bed. When the guide means 3 have located on guide posts 5, the beam 1 can be lowered from a near vertical orientation to a near horizontal orientation as shown in FIG. 2. The beam 1 is attached at one end by flanges 8 to the hinge means 2, and at the other end to the remote release mechanism 9. A funnel 10 is connected to the beam 1 by the remote release mechanism 9, and in FIG. 2 the funnel 10 is shown resting on the sea bed at a set distance from and orientation with respect to the first guide base 6. The beam assembly was lowered by wire 11, and by pulling the release wire 12 when the beam assembly is horizontal, the funnel can be detached and the beam recovered.

FIG. 3 shows a section of the remote release mechanism 9 of FIGS. 1 and 2, and the left hand side shows the attachment pins 13 locked, while the right hand side shows the pins in the released position. The channel section 14 is integral with the funnel 10 and has slots 15 through which the pins 13 can pass. The pins 13 slide through bearings 16 mounted on the plate 17 which is rigidly attached to the beam 1. When locked, the toggle link arms 18 are in line with the pins 13, but when the release wire 12 is pulled the link arms 18 adopt the inclined orientation shown on the right hand side of FIG. 3. Right and left hand attachment pins 13 retract to equal extents because the centre pivot block 19 is guided by a vertical slot in the bracket 20.

Clearly this remote release mechanism will operate more easily when the release wire 12 extends generally perpendicular to the beam 1, i.e. when the beam 1 is horizontal, than when the beam is vertical such as during the lowering operation. In FIG. 4 there is shown the stage when the first well has been completed, the guide wires 4 removed, and the drilling rig has moved to be positioned over the funnel 10 to drill the second well. The second temporary guide base 21 is lowered on drill pipe 22 using a running tool 23. Four guide wires 24 are attached. A remotely controlled vehicle 25 carrying a low-light TV camera, and with compass attached, allows personnel on board the drilling rig to watch the temporary guide base 21 as it approaches the funnel 10. The rig can then be positioned using its anchor winches so that the temporary guide base 21 smoothly enters the funnel 10 and rests correctly on the sea bed.

It will be appreciated that the generally square funnel 10 locates the TGB 21 of the second well in one of four different orientations such that, given the fact that the hinge 2 prevents swivelling about a vertical axis, the guide wires 24 of the second well will be in a square arrangement orientated so that two opposite sides of that square will be collinear with two opposite sides of the square on which the first guide wires 4 of the first well are arranged. This facilitates the task of tying in the various wells of a cluster to product recovery pipework. The funnel 10 could instead be circular but would not then help to orientate the TGB 21 or its PGB (not shown); instead it would simply define a unique position for the centre line of each new well of the cluster in relation to the position and orientation of the first well.

The funnels of the guide means 3 are capable of being introduced onto the guide wires 4 in that each funnel is longitudinally slotted to allow the wire 4 to pass radially inwardly to the interior of the funnel.

The embodiment shown in FIGS. 5 and 6 is an example of the use of the guide means 3 to position an anchor block for product flow lines from the well under the PGB6.

FIG. 5 shows a view similar to FIG. 2 where the beam 1 is in the lowered configuration and the release wire 12 is about to be pulled in order to operate the release mechanism 9 to free an anchor block 30 which, as shown in FIG. 6, is subsequently pinned to the sea bed by cemented finned piles 31 and serves to clamp flow lines 32 (either for removal of the product liquid, in this case a hydrocarbon product, or to supply a secondary recovery liquid such as injection water or lifting gas).

The anchor block 30 has a projection 33 (FIG. 6) which is similar to the bracket on the guide funnel 10 of FIG. 2 and serves to engage the release mechanism 9. Thus there is no modification needed to the lowering mechanism of FIG. 1 unless, as in this case, a different configuration of beam 1 has been used where the spacing of the anchor block 30 from the first well is different from the centre-to-centre spacing between the PGB6 and the TGB of the second well in the FIG. 2 arrangement.

The beam 1 can be built-up from a set of flanged-ended tubes which can be connected together in any number in order to provide the desired length of beam, i.e. the distance between the flanges 8 at opposite ends of the beam as a whole.

FIG. 6 shows the configuration of the system after operation of the remote release mechanism and shows that the anchor block 30 has been placed on the sea bed close to the existing well installation consisting of the Christmas tree 35 mounted on the PGB 6 which is itself supported on the TGB 7. The pinning of anchor block 30 to the sea bed is achieved by means of two finned piles the upper portions of which can be seen in FIG. 6, and these piles are cemented in placed in drilled holes which are drilled through the guide funnels 30' shown in FIG. 5.

The flow lines 32 are clamped by means of straps 34 to the anchor block 30 and a short portion of each flow line projects clear of the anchor block 30 to a coupling 36 where spool fittings 37 are to be connected such that each spool fitting 37 is at one end connected at the coupling 36 to one of the flow lines 32 and is at the other end connected to an appropriate pipe fitting forming part of the Christmas tree assembly 35 mounted on the TGB 7.

An advantage of using the beam 1 and remote release mechanism 9 pivotally supported on the guide means 3 for positioning the anchor block at a given distance from the well head at TGB 7, and also at a predetermined orientation with respect to the well head and its Christmas tree 35, is that the spool fittings 37 can be standardised so that only two lengths of fitting 37 are required in order to achieve the connections illustrated in FIG. 6. Without this guaranteed spacing and orientation of the anchor block 30 with respect to the existing PGB 6 and wires 4, it will be necessary for the spool fittings 37 to be tailor-made to suit each individual situation. Thus, with the apparatus illustrated in FIGS. 5 and 6, there is a considerable saving in installation time spent on site and in turn the use of standardised spool fittings will cut down material costs in that precisely the required number of pre-assembled spool fittings 37 will be supplied and there will be no need for stock piping to be carried on the rig for use in the manufacture of tailor-made spool fittings once the anchor block 30 has been placed without the precise guiding afforded by the apparatus of this invention.

The existance of the anchor block 30 clamping the flow lines 32 to the sea bed close to the well head serves to minimise the effect of any damage by disturbance of the flow lines 32, for example by being struck by trawl boards or ship's anchor cables, and in order further to minimise the effects of any such damage a cage 38 can be seen in FIG. 6 as covering the entire well head assembly 6, 7, 35 and the anchor block 30.

Although, as shown in FIG. 6, the cage 38 extends outwardly beyond the anchor block 30, it is of course possible for the cage to be made smaller so that it still protects the christmas tree but provides access to the anchor block and eliminates the possibility of the flow lines 32 being damaged during lowering of the cage 38.

We claim:

1. A method of locating first and second spaced underwater structures of which said first structure is a hydrocarbon well, such method comprising drilling a hole for said well; lowering a permanent guide base and conductor piping into position in relation to said hole, providing guide wires extending back from the permanent guide base to the drilling rig at the surface; attaching to said guide wires a beam having at a first end guide means for cooperation with the guide wires to guide said beam vertically down the guide wires, and having at the other end a remote release mechanism to permit attachment to and release of a means to position a second underwater well, the first end of said beam being attached to said guide means by way of a hinge permitting the beam to be pivoted between a vertical orientation and a horizontal orientation; attaching to said remote release mechanism a means to position said second underwater structure; lowering said beam in a vertical orientation down said guide wires to the permanent guide base of the first well; at the permanent guide base pivoting said beam into a horizontal orientation to bring said means to position said second underwater structure into a position at the sea bed spaced at a predetermined distance from said permanent guide base of the first well; operating said remote release mechanism to release said beam from said means to position a second underwater structure; and recovering said beam, hinge and guide means by raising them up the said guide wires in a vertical orientation.

2. A method as set forth in claim 1, wherein said second underwater structure is a second hydrocarbon well and further including the steps of (a) drilling a further hole below said means to position a second underwater structure and (b) locating a further permanent guide base above said further hole.

3. A method as set forth in claim 2, wherein said means to position a second underwater structure comprises a releasable guide socket for receiving a temporary guide base of the second hydrocarbon well; and the step of attaching said means to position a second underwater structure includes the step of arranging said temporary guide structure in said guide socket.

4. A method as set forth in claim 1, wherein said second underwater structure is an anchor block for securing flow lines to the sea bed alongside said underwater hydrocarbon well; such method comprising attaching the anchor block to said remote release mechanism before lowering said beam in a vertical orientation down said guide wires to the permanent guide base of the said underwater hydrocarbon well; and after operating said remote release mechanism to release said beam from said anchor block, recovering said beam, remote release mechanism hinge and guide means by raising them up the said guide wires in a vertical orientation; then drilling through said anchor block to form holes in the sea bed to receive pinning piles; inserting and cementing piles through said anchor block to hold the anchor block in place on the sea bed; attaching flow lines to said anchor block; and connecting said attached flow lines to the underwater hydrocarbon well for recovery of fluid from said well.

5. A method as set forth in claim 1, 2, 3 or 4, wherein there are four said guide wires to the permanent guide base of said first underwater structure and two adjacent ones of said wires are used to guide said guide means.

6. A method as set forth in claim 2, wherein there are four said guide wires to the permanent guide base of said first underwater structure, arranged such that they are at the corners of a square; and further including the step of positioning at said second well a permanent guide structure and an array of four guide wires such that the guide wires of the second well lie at the corners of a horizontal square whose sides are equal and parallel to corresponding sides of a horizontal square at the corners of which the guide wires of the first underwater structure are arranged.

7. A method as set forth in any one of claims 1, 2, 3 and 6, wherein said beam is lowered to said permanent guide base of said first underwater structure by means of a lifting wire, and said remote release mechanism is operated by means of a second wire serving as a release wire.

8. Apparatus for positioning a submarine structure on the sea bed alongside an underwater well, such apparatus consisting of a beam having a longitudinal axis and first and second ends; guide means at said first end of said beam to guide said beam as the beam is lowered to the sea bed, said guide means comprising spaced inverted funnels and means defining vertical slots in said funnels to allow the funnels to be threaded laterally onto two laterally spaced vertical guide wires; hinge means connecting said guide means to said first end of the beam for pivoting of said beam relative to said guide means about a hinge axis which is perpendicular to said longitudinal axis of the beam; and a remote release mechanism at the second end of said beam operable to permit attachment of said submarine structure to said second end of the beam and operable from the sea surface to release said submarine structure from said second end of the beam for recovery of said beam to the sea surface.

9. Apparatus for positioning a submarine structure on the sea bed alongside an underwater well, comprising a beam having longitudinal axis and comprising a centre portion and first and second end portions, said centre portion having flanged ends, and said first and second end portions, each having first and second ends, said first ends being correspondingly flanged to engage the respective said flanged ends of said centre portion whereby said centre portion may be removed and replaced by a centre portion having similar flanges but having a different overall length; guide means at said second end of said first end portion of said beam to guide said beam as the beam is lowered to the sea bed, said guide means comprising spaced inverted funnels and means defining vertical slots in the said funnels to allow the funnels to be threaded laterally onto two laterally spaced apart vertical guide wires; hinge means connecting said guide means to the second end of said first end portion of the beam for pivoting of said beam relative to said guide means about a hinge axis which is perpendicular to said longitudinal axis of the beam; and a remote release mechanism carried by said second end portion of the beam and operable to permit attachment of a said submarine structure to said second end portion of the beam and operable from the sea surface to release said submarine structure from said second end portion of the beam for recovery of said beam to the sea surface, whereby substitution of said centre portion of the beam by an alternative centre portion having corresponding flanges but of different length enables the spacing between said submarine structure and said underwater well to be selected accordingly.

10. Apparatus according to claim 8 or 9, wherein said remote release mechanism is operable by means of a release wire and is more readily operable when the tension in said release wire acts generally perpendicular to said beam rather than along the beam axis.

11. Apparatus as set forth in claim 8 or 9, wherein said submarine structure is an anchor block for pinning the ends of flow lines to the sea bed, and said release mechanism is directly engageable with a said anchor block for supporting the anchor block until activation of the release mechanism once the anchor block is on the sea bed.

12. Apparatus according to claim 8 or 9, wherein said means to position a submarine structure comprises a socket dimensioned to locate a temporary guide base for a subsequent underwater well.

* * * * *